US006662961B2

(12) United States Patent
Yourist

(10) Patent No.: US 6,662,961 B2
(45) Date of Patent: Dec. 16, 2003

(54) PLASTIC CONTAINER HAVING STRUCTURAL RIBS

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/294,695

(22) Filed: Nov. 15, 2002

(65) Prior Publication Data

US 2003/0168426 A1 Sep. 11, 2003

Related U.S. Application Data

(63) Continuation-in-part of application No. 29/156,726, filed on Mar. 7, 2002.

(51) Int. Cl.[7] ..... B65D 1/46; B65D 23/00

(52) U.S. Cl. ..... 215/382; 215/365; 215/381; 220/669; 220/671; 220/674; 220/675

(58) Field of Search ..... 215/381, 382, 215/379, 42, 365; D9/307, 530, 516; 220/666, 671, 675, 669

(56) References Cited

U.S. PATENT DOCUMENTS

| | | | | | |
|---|---|---|---|---|---|
| D97,986 | S | * | 12/1935 | Brenner | D9/530 |
| 5,067,622 | A | * | 11/1991 | Garver et al. | 215/382 |
| 5,222,615 | A | * | 6/1993 | Ota et al. | 215/382 |
| 5,762,221 | A | | 6/1998 | Tobias et al. | 215/381 |
| 5,803,289 | A | * | 9/1998 | Brady | 215/365 |
| 6,016,932 | A | * | 1/2000 | Gaydosh et al. | 215/382 |
| 6,044,996 | A | * | 4/2000 | Carew et al. | 215/381 |
| 6,044,997 | A | | 4/2000 | Ogg | 215/381 |
| D426,460 | S | * | 6/2000 | Krishnakumar et al. | D9/307 |
| D439,166 | S | * | 3/2001 | Denner et al. | D9/538 |
| 6,213,326 | B1 | * | 4/2001 | Denner et al. | 215/383 |
| 6,257,433 | B1 | | 7/2001 | Ogg et al. | 215/381 |
| 6,273,282 | B1 | | 8/2001 | Ogg et al. | 215/381 |

OTHER PUBLICATIONS

United States Patent Application No. Publication 2002/0000421 A1 to Ota et al Published Jan. 2002.*

* cited by examiner

*Primary Examiner*—Sue A. Weaver
(74) *Attorney, Agent, or Firm*—Venable LLP; Keith G. Haddaway; Stuart I. Smith

(57) ABSTRACT

A blow molded container is provided. The container has a base, a body portion attached to the base, a concave waist attached to the body portion, a dome attached to the waist, a plurality of structural ribs, and a finish attached to the dome. The dome has a plurality of panels arranged around a perimeter of the dome. The finish has an opening and a portion of the dome is located between the panels and the waist. Each of the structural ribs is located between two adjacent panels and is raised relative to the panels.

12 Claims, 4 Drawing Sheets

PLASTIC CONTAINER HAVING STRUCTURAL RIBS

This application is a continuation-in-part of U.S. Design Patent Application No. 29/156,726 filed Mar. 7, 2002, pending, which is hereby incorporated by reference in its entirety.

BACKGROUND OF THE INVENTION

1. Field of the Invention

The present invention generally relates to a container, and more particularly to such containers that are typically made of polyester and are capable of being filled with hot liquid. It also relates to an improved dome construction for such containers.

2. Statement of Related Art

"Hot-fill" applications impose significant and complex mechanical stress on the structure of a plastic container due to thermal stress, hydraulic pressure upon filling and immediately after capping the container, and vacuum pressure as the fluid cools.

Thermal stress is applied to the walls of the container upon introduction of hot fluid. The hot fluid causes the container walls to first soften and then shrink unevenly, causing distortion of the container. The plastic material (e.g., polyester) is often, therefore, heat-treated to induce molecular changes resulting in a container that exhibits thermal stability.

Pressure and stress also act upon the sidewalls of a heat resistant container during the filling process and for a significant period of time thereafter. When the container is filled with hot fluid and sealed, the container is subjected to an increased internal pressure. As the liquid and the air headspace under the cap subsequently cools, thermal contraction results in a decrease in pressure in the container. The vacuum created by this cooling tends to mechanically deform the container walls.

Containers for liquid are often shipped in cardboard boxes that are stacked on top of each other during storage and shipping. The containers have exhibited a limited ability to withstand top loading during filling, capping and stacking for transportation. Overcoming these problems is important because it would decrease the likelihood of a container's top or shoulder being crushed, as well as inhibiting ovalization in this area. It is important to be able to stack containers so as to maximize the use of shipping space. Due to the weight of liquid-filled containers, the boxes often need reinforcing such as egg crate dividers to prevent crushing of the containers. The vulnerability of the containers to crushing can be increased by the deformation resulting from the above-mentioned vacuum.

A particular problem which can result from the hot-filling procedure is a decrease in the container's ability to withstand top loading during filling, capping and labeling. Because of the decreased container rigidity immediately after filling and after cooling, even heat set containers are less able to resist loads imparted through the top or upper portion of the container, such as when the containers are stacked one upon the other for storage and shipping. Similar top loads are imparted to the container when it is dropped and lands on the upper portion or mouth of the container. As a result of this top loading, the container can become deformed and undesirable to the consumer.

SUMMARY OF THE INVENTION

Embodiments of the invention provide a container dome structure that helps reduce the container deformation described above. In addition, the invention provides a container dome structure with sufficient topload strength to allow significant reduction in secondary packaging requirements. For example, the need for using "egg crate dividers" may be reduced or eliminated.

Particular embodiments of the invention provide a blow molded container having a base, a body portion attached to the base, a concave waist attached to the body portion, a dome attached to the waist, a plurality of structural ribs, and a finish attached to the dome. The finish has an opening and a portion of the dome is located between the panels and the waist. The dome has a plurality of panels arranged around a perimeter of the dome. Each of the structural ribs is located between two adjacent panels and is raised relative to the panels.

Other embodiments of the invention provide a blow molded container having a base, a body portion attached to the base, a concave waist attached to the body portion, a dome attached to the waist, four structural ribs, and a finish attached to the dome. The finish has an opening. The dome has four panels evenly spaced around a perimeter of the dome. Each of the structural ribs is located between two adjacent panels. A portion of the dome is located between the panels and the waist, is circular in cross section, and has a larger diameter than the waist. Each of the structural ribs is raised relative to the panels and at least one of the structural ribs is incorporated into a graphical image that represents a material for which the container is made.

BRIEF DESCRIPTION OF THE DRAWINGS

The foregoing and other features and advantages of the invention will become more apparent from the following detailed description of preferred embodiments when considered in conjunction with the accompanying drawings, wherein.

DETAILED DESCRIPTION OF PREFERRED EMBODIMENTS

Figure 1:
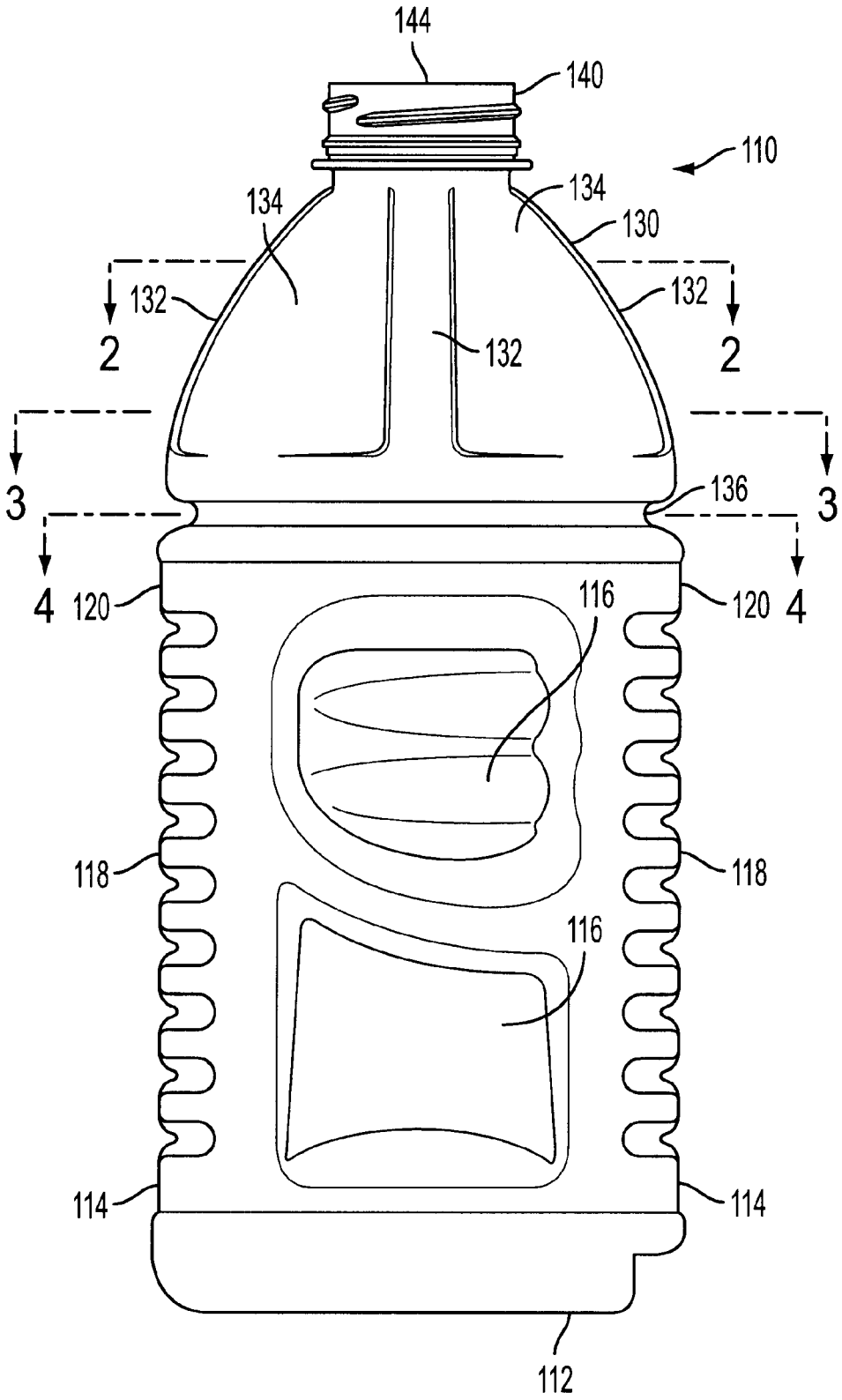
FIG. 1 illustrates a side elevation view of a container according to a first embodiment of the invention.

Referring now to the drawings, wherein like reference characters or numbers represent like or corresponding parts throughout each of the several views, there is shown in FIG. 1 a blow-molded plastic container 110 having a reinforced dome 130 according to the invention. Dome 130 is designed to provide an aesthetically pleasing package as well as improved control of dome distortion caused by top-loading. Container 110 is an example of a container used to package liquids, such as, for example, beverages. However, container 110 can also be used to contain powders or other flowing materials. A specific example of a use of container 110 is to contain 32 oz. of a hot-fillable juice.

Attached to dome 130 is a finish 140 having an opening 144. In some embodiments, finish 140 is threaded to receive a threaded cap. Attached to dome 130 at an end opposite finish 140 is a waist 136. Waist 136 generally has a smaller cross-sectional area than does a lower portion of dome 130. Below waist 136 is an upper label bumper 120. Upper label bumper 120 and a lower label bumper 114 are upper and lower limits for label mounting areas 118. Upper label bumper 120, label mounting areas 118 and lower label bumper 114 provide surfaces for labels to be affixed with, for example, glue to container 110. In this example, flexible panels 116 are provided outside label mounting areas 118 to provide strength and/or to accommodate volumetric changes to a hot-fill container after it has been sealed and as it cools. In other embodiments, flexible panels can be provided within label mounting areas such that labels cover the flexible panels. A base 112 is provided at the bottom of container 110.

The embodiment of dome 130 shown in FIG. 1 has a larger cross-sectional area at its lower extremity than does the smallest portion of waist 136. In this example, dome 130 has its maximum cross-sectional area at this lowest point. Also, dome 130 is generally circular in cross section, with the diameter of the cross section becoming smaller as the distance from waist 136 increases. This reduction in diameter produces an inwardly sloping dome as one moves toward finish 140.

The embodiment of the invention shown in FIG. 1 has a plurality, in this example four, panels 134. The plurality of panels 134 are separated in this example by a structural rib 132 between each pair of adjacent panels 134. Structural ribs 132 extend in an axial direction of container 110. Structural ribs 132 provide increased rigidity to container 110 that can make container 110 sufficiently strong to support the weight of multiple similar filled containers. Structural ribs 132 can be substantially rectangular in cross section and have either sharp or rounded corners. Structural ribs 132 are preferably sized such that they are no larger than panels 134 in a circumferencial direction of the container, and, more preferably, less than one half the size of panels 134 in the circumferencial direction. This strength is valuable as it can allow the shipping of a plurality of containers in boxes without additional reinforcing such as, for example, egg crate dividers while still permitting multiple boxes to be stacked on each other.

In addition to the benefits discussed above, panels 134 provide surfaces for product logos or other graphics. Structural ribs 132 can be incorporated into these or other logos or graphics, particularly graphics having an elongated element such as, for example, a tree. The logos or graphics can be incorporated into the mold for the container, resulting in panels 134 and/or structural ribs 132 being embossed with the logo or graphic. By combining the structural qualities of structural ribs 132 with valuable marketing graphics, the invention addresses two design problems with one integrated solution.

Figure 2:
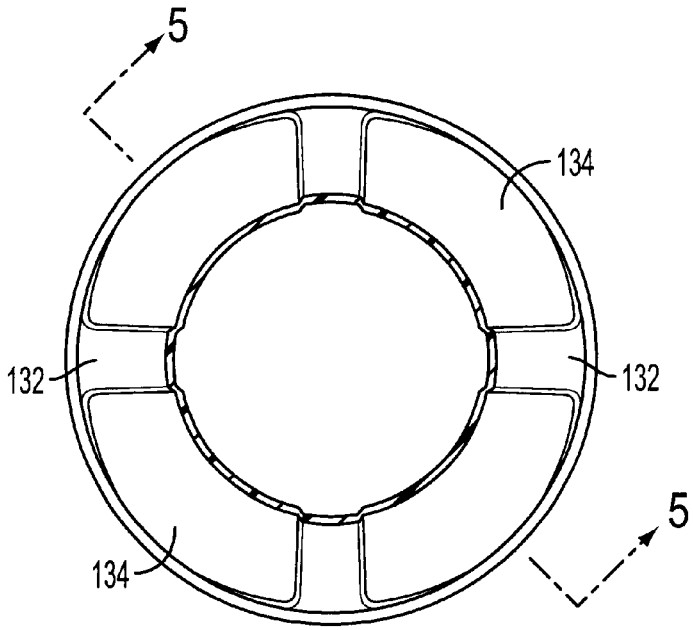
FIG. 2 illustrates a sectional view along section line 2—2 of the container shown in FIG. 1.
Figure 3:
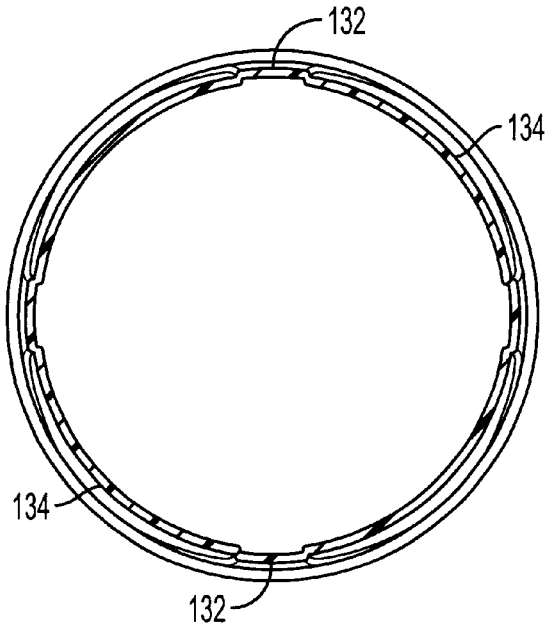
FIG. 3 illustrates a sectional view along section line 3—3 of the container shown in FIG. 1.
Figure 4:
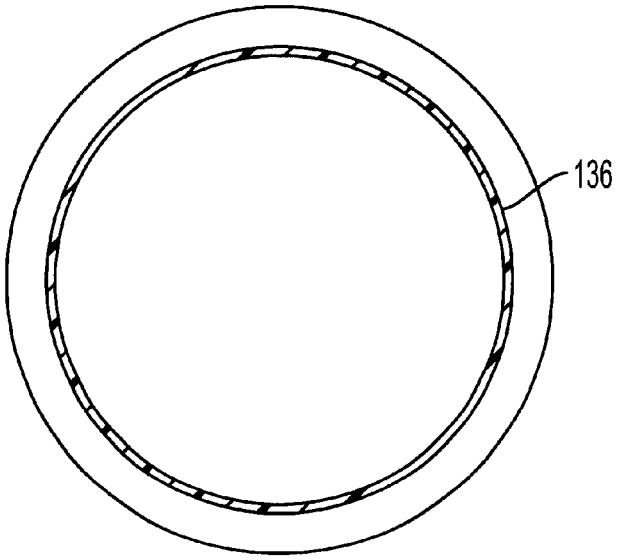
FIG. 4 illustrates a sectional view along section line 4—4 of the container shown in FIG. 1.

FIGS. 2–4 show cross sections through container 110. FIGS. 2 and 3 show cross sections through upper and lower portions of dome 130, respectively. FIGS. 2 and 3 show cross sections through panels 134 and structural ribs 132. These Figures show that, in this example, the cross section of dome 130 is substantially circular except for structural ribs 132. Other shapes such as, for example, oval and substantially rectangular, can be used as a basis for the cross sectional shape. The corners formed where panels 134 meet structural ribs 132 provide strength that increases the strength of the container along the longitudinal axis of the container. This added strength is beneficial in that it can eliminate or reduce the need for reinforcement in boxes used to ship and store the containers. FIG. 4 shows a cross section through waist 136. In this example, waist 136 has a circular cross section. However, other cross-sectional shapes, such as, for example, oval or substantially rectangular, can be used.

Figure 5:
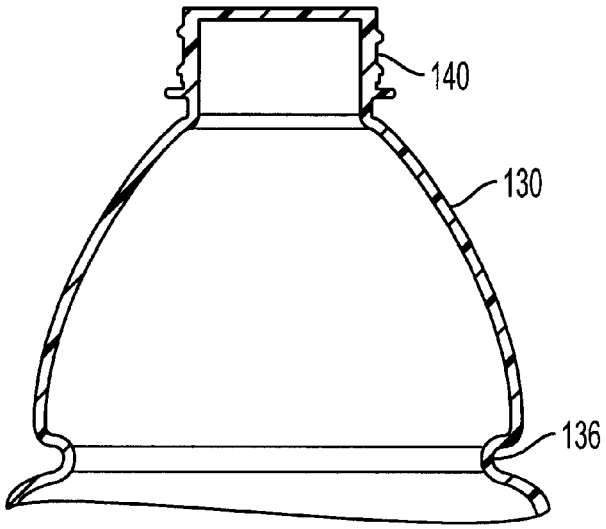
FIG. 5 illustrates a partial sectional view along section line 5—5 of the container shown in FIGS. 1 and 2.

FIG. 5 shows a vertical section through finish 140, dome 130 and waist 136.

Figure 6:
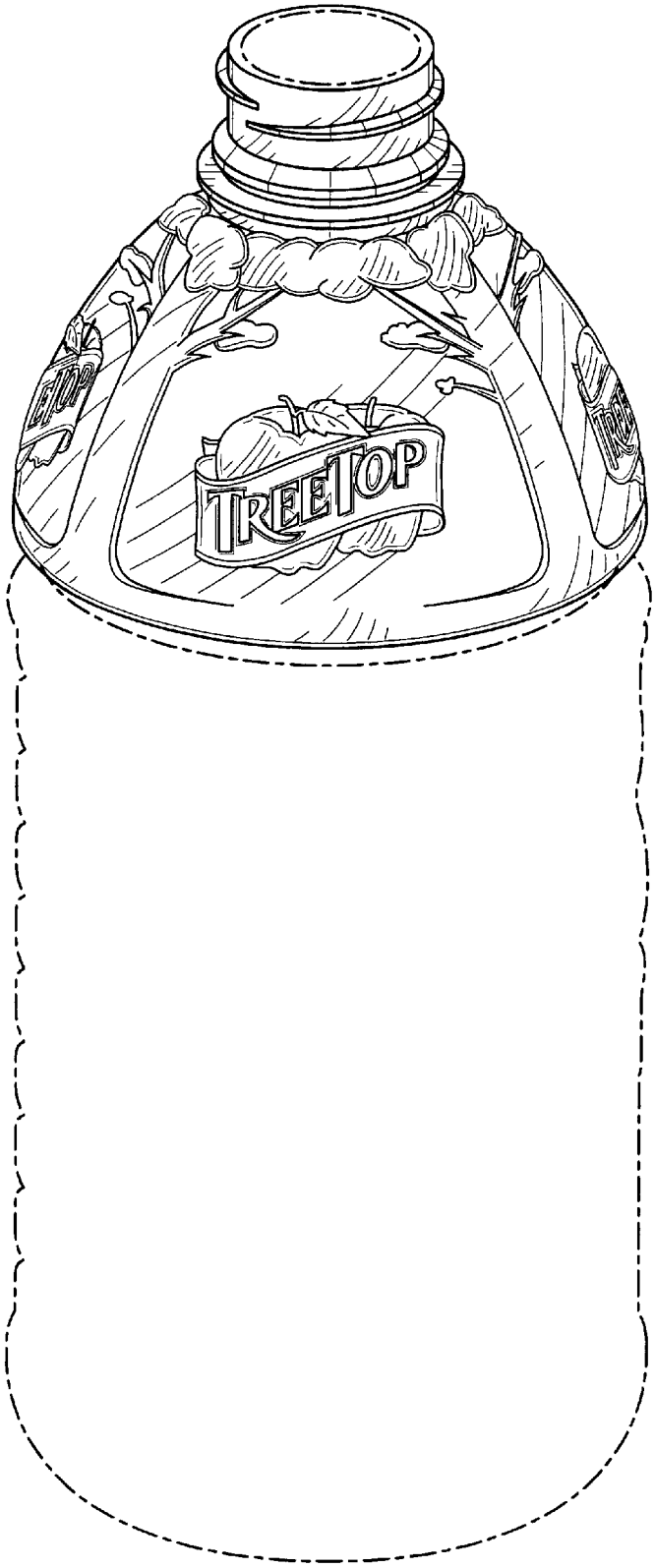
FIG. 6 shows an example of the invention having a graphical image incorporated into the structural ribs.

FIG. 6 shows an example of the invention having the structural ribs incorporated into a graphical image.

The container of the present invention may comprise any material known in the art and generally used for the described applications as well as others. These materials include plastics, for example, polyethylene terephthalate (PET), low density polyethylene (LDPE), high density polyethylene (HDPE), and nylons, as well as other polyesters, polyolefins, polycarboxyamides, and polycarbonates having suitable properties for the intended application. The bottles can be manufactured from resilient and pliable plastic materials so that they are squeezable.

As shown by the examples of the invention described herein and illustrated in the drawings, the invention provides a container having beneficial strength and incorporates the structural members that give this strength into visual features that are beneficial for marketing purposes.

Although particular embodiments of the invention are shown and described, it is noted that other embodiments of the invention will be apparent to those skilled in the art to which the invention pertains upon review of this disclosure. These and other embodiments are considered to be in the spirit of, and part of, the invention.

What is claimed is:

1. A blow molded container, comprising:

a base;

a body portion attached to the base;

a concave waist attached to the body portion;

a dome attached to the waist, the dome having a plurality of panels arranged around a perimeter of the dome;

a plurality of structural ribs; and a finish attached to the dome, the finish having an opening, wherein a portion of the dome is located between the panels and the waist, each of the structural ribs is located between two adjacent panels, each of the structural ribs is raised relative to the panels, and at least one of the structural ribs is incorporated into a graphical image that represents a material for which the container is made.

2. The container of claim 1, wherein the waist is circular in cross section.

3. The container of claim 2, wherein the portion of the dome located between the indented panels and the waist is circular in cross section and has a larger diameter than the waist.

4. The container of claim 1, wherein the dome has four panels.

5. The container of claim 4, wherein the structural ribs are substantially vertical.

6. The container of claim 4, wherein the four panels are spaced uniformly around the dome.

7. The container of claim 1, wherein the graphical image is raised relative to the panels.

8. The container of claim 7, wherein the graphical image represents a tree having branches.

9. The container of claim 1, wherein at least one of the panels has a graphic embossed in a surface of the panel.

10. A blow molded container, comprising:

a base;

a body portion attached to the base;

a concave waist attached to the body portion, the waist being circular in cross section;

a dome attached to the waist, the dome having four panels evenly spaced around a perimeter of the dome;

four structural ribs, each of the structural ribs being located between two adjacent panels; and a finish attached to the dome, the finish having an opening, wherein a portion of the dome is located between the panels and the waist, the portion of the dome located between the panels and the waist is circular in cross section and has a larger diameter than the waist, each of the structural ribs is raised relative to the panels, and at least one of the structural ribs is incorporated into a graphical image that represents a material for which the container is made.

11. The container of claim 10, wherein the graphical image is raised relative to the panels.

12. The container of claim 11, wherein the graphical image represents a tree having branches.

* * * * *